US005174052A

United States Patent [19]

Schoenhaus et al.

[11] Patent Number: 5,174,052

[45] Date of Patent: Dec. 29, 1992

[54] DYNAMIC STABILIZING INNER SOLE SYSTEM

[76] Inventors: Harold D. Schoenhaus, 1817 Fireside Ct., Cherry Hill, N.J. 08003; Richard M. Jay, 340 S. Sixth St., Philadelphia, Pa. 19106

[21] Appl. No.: 637,308

[22] Filed: Jan. 3, 1991

[51] Int. Cl.[5] ..... A61F 5/14

[52] U.S. Cl. ..... 36/144; 36/176; 36/174

[58] Field of Search ..... 128/581, 595, 614, 615; 36/28, 43, 44, 71, 25, 43, 44, 140, 144, 154, 173, 174, 176

[56] References Cited

U.S. PATENT DOCUMENTS

| | | |
|---|---|---|
| 2,255,100 | 9/1941 | Brady . |
| 3,861,398 | 1/1975 | Leydecker . |
| 4,232,457 | 11/1980 | Mosher . |
| 4,360,027 | 11/1982 | Friedlander et al. . |
| 4,446,633 | 5/1984 | Scheinhaus et al. . |
| 4,506,460 | 3/1985 | Rudy . |
| 4,510,700 | 4/1985 | Brown . |
| 4,597,196 | 7/1986 | Brown . |
| 4,747,410 | 5/1988 | Cohen . |
| 4,759,357 | 7/1988 | Allart et al. . |
| 4,793,078 | 12/1988 | Andrews . |
| 4,841,648 | 6/1989 | Shaffer et al. . |
| 4,910,886 | 3/1990 | Sullivan et al. . |
| 4,979,318 | 12/1990 | Cohen . |

OTHER PUBLICATIONS

Doxey, G. E., "Clinical Use and Fabrication of Molded Thermoplastic Foot Orthotic Devices", Physical Therapy, Nov. 1985, vol. 65, No. 11, pp. 1679-1682.

Menkveld et al, "Analysis of Gait Patterns in Normal School-Aged Children", J. Ped. Ortho., vol. 8, No. 3, 1988, pp. 263-267.

Kalen, et al, "Relationship Between Adolescent Bunions and Flatfeet" Foot & Ankle, vol. 8, No. 6, Jun. 1988, pp. 331-336.

Conniff, M. A. "They Say You Want a Revolution", Hippocrates, Sep./Oct. 1987, pp. 69-79.

Jay, R. M., "Orthoses for Cerebral Palsy Patients", Current Podiatric Medicine, Jan. 1989, pp. 26-27.

Gross et al "Measurement of Discrete Vertical In-shoe Stress With Piezoelectric Transducers," J. Biomed. Eng. May 1988, vol. 10, pp. 261-265.

Johnson, G. R., "The Effectiveness of Shock-absorbing insoles during Normal Walking", Prosthetics and Orthotics Int, 1988, 12, pp. 91-95.

Minns et al, "A study of Foot Shape, Underfoot Pressure Patterns, Lower Limb Rotations and Gait of Children", Chiropodist, Mar. 1986, pp. 89-99.

Smith et al, "The Effects of Soft and Semi-rigid Orthoses Upon Rearfoot Movement in Running", J. Amer. Pod. Med. Assoc., Apr. 1986, pp. 227-233.

Otman et al, "Energy Cost of Walking with Flat Feet", Prosthetics and Orthotics International, 1988, 12, pp. 73-76.

Murphy, P., "Orthoses: Not the Sole Solution for Running Ailments", The Physician and Sports Medicine, vol. 14, No .2, Feb. 1986, p. 164-168.

Robertson et al, "A Comaprison and Classification of Forefoot Pressures in Young and Middleaged Adults Using a Pedobarograph", Chiropodist, Mar. 1985, p. 62-69.

McPoil et al, "Biomechanics of the Foot in Walking: A Function of Approach", J. of Ortho. and Sports Phys. Ther., vol. 7, No. 2, pp. 69-72.

Gould, N. —"The Developemnt of the Toddler Arch", Foot and Ankle, 9(5):241, 1989.

Gould, N.—"Shoes versus Sneakers in Toddlers". Foot Ankle, 6(2):105, 1985.

(List continued on next page.)

*Primary Examiner*—Richard J. Apley
*Assistant Examiner*—Linda C. M. Dvorak
*Attorney, Agent, or Firm*—Hayes, Soloway, Hennessey & Hage

[57] ABSTRACT

An orthotic device for preventing hyperpronation of a human foot has a deep heel seat to cup the calcaneous and maintain it in approximately 5 degrees of varus, and high medial and lateral flanges which prevent lateral transverse drift of the first and fifth metatarsals.

2 Claims, 8 Drawing Sheets

OTHER PUBLICATIONS

Wenger, D.—"Foot Growth Rate in Children". Foot and Ankle, 3(4):207, 1983.

Gould, N.—"Foot Growth in Children". Foot and Ankle, 10(4: 211, 1990.

Cowell, H.—"Shoes and Shoe Corrections". Ped. Clinics of North America, 24(4):791, 1971.

Bleck, E.—"The Shoeing of Children". Dev. Med Ped. Neuro., 13:188, 1971.

Knittel, G.—"The Effectivness of Shoe Modifications for in-toeing". Orhop. Clinics of North America, 7:1019, 1976.

Wickstrom, J.—"Shoe Corrections and Orthopedic Foot Supports". Clin. Ortho. 70:30, 1970.

DYNAMIC STABILIZING INNER SOLE SYSTEM

BACKGROUND OF THE INVENTION

The present invention relates to an orthopedic device for the prevention of hyperpronation.

The realization and association of hyperpronation as a cause of symptoms in patients has been well recognized. Hyperpronation or flattening of the longitudinal arch of the foot is associated with the development of problems intrinsic to the foot such as heel spurs, bunions and hammertoes as well as symptoms extrinsic to the foot such as knee pain and low back pain. The shoe wear industry has attempted through corrective shoes to control some of the hyperpronation. In-shoe modifications as well as heel modifications, such as the Thomas heel, have been utilized for years but have been relatively ineffective. the development of an in shoe modification based upon biomechanical principles and design can control hyperpronation and prevent symptoms from developing in a large percentage of the patient population. With the population of the United States and the world being an extremely active one there is a high incidence of lower extremity problems secondary to hyperpronation which have caused significant losses of man hours as well as escalating costs in hospitalization and patient care.

The observation of hyperpronation may be made as soon as the child is born; in many cases some deformities which can be treated with casts. However, the majority of patients go undetected until they bear weight and wear shoes. Early recognition and detection of hyperpronation and its control is essential to allow the foot to develop in a normal position with normal contour of soft tissue and bone. Unfortunately, many patients continue to function in an abnormal pronated position throughout their childhood, adolescence and adult life. It is for this reason that the in-shoe modification is indicated for all age groups who are of a weight bearing capacity. Ideally in a younger age category the concept of the present invention deals with restoration of normal position with an allowance of the osseous and soft tissue structures to realign and adjust to the new position. As age increases the chance for realignment and remolding of the osseous and soft tissue structures becomes less and the need for control becomes that much more continuous so that these patients can be maintained in a controlled position with the use of the device of the present invention. Sporting activities accelerate and exaggerate hyperpronation, thus increasing symptoms and the need to control more important. It is for this reason that the present invention is useful in the age category beginning with weight bearing in the child at approximately one to one and a half years of age and continuing through the geriatric population including patients of weight bearing age and of any age. The invention itself can take on various physical forms which include the following:

1. Part of the actual insole of the shoe, whether it be a running shoe or a walking shoe. This would be part of the construction of the shoe itself and would be immovable.
2. A device that can be placed within the shoe and be removable.
3. A device that can be made from a cast of the foot with the foot being held in a correct position and thus taking on the design of an orthotic contour to the exact shape of the patients foot.
4. A prefabricated device size-dependent and age-dependent which could be dispensed at the office of a Podiatrist, Orthopedist, Pediatrician, Chiropractor etc. as the need is determined.
5. The availability of the device to be purchased as an insert as an over-the-counter product.

BRIEF SUMMARY OF THE INVENTION

The design concept of the present invention deals with a deep heel seat which will be able to cup the heel bone or calcaneus and maintain it in correct alignment relative to the leg and ground which has been determined to be approximately five degrees of varus. This inverted position is accomplished by a unique design which off sets the interior of the heel cup in a manner which differs from any other concept design. All other orthotics, in attempt to invert the heel, attempt to do it from the plantar aspect of the insert itself or the shoe. This new design concept of off-setting the calcaneus within the interior of the cup will give direct contact control. It is essential that the heel be placed in an inverted position at heel strike at walking cycle so that the foot can be controlled from the point of contact. As a patient continues to walk and the foot contacts the ground, weight transfer travels through the foot from the heel to the midfoot and finally to the forefoot which results in propulsion. It is essential to control all aspects of contact with the ground, starting with the point of heel strike. It is well recognized that the position of the calcaneus and heel have a controlling capability of the mid tarsal joint. This represents the area of the longitudinal arch and mid foot region. The control of the calcaneus and the mid foot is accomplished through the inverted position of the calcaneus as well as the use of two flanges that continue along the sides of the shoe and the foot and support the foot to the level of the first and fifth metatarsal necks.

The deep heel seat is off set to maintain the calcaneus in an inverted position but allow normal pronation to occur. The lateral flanges of the present device extending to the neck of the metatarsals one and five function in a different capacity. Based upon the mechanics of the foot the calcaneus cuboid and the entire foot abduct with pronation and the talus adducts with pronation. The stiff lateral counter which extends high in the present device from the cup of the heel seat and continues along the entire lateral border is designed to prevent a lateral shifting of the entire foot which occurs in conjunction with the medial shift or rotation of the talus. In pronation the talus plantar flexes and adducts while the calcaneus and the rest of the fore foot abduct. There is a component of eversion of the calcaneus with pronation and this is controlled by the off set inverted heel cup of the invention. The combination of the off set heel seat in the invention and the long lateral flange extended to the neck of the fifth metatarsal are unique. The medial flange and the offset varus heel controls the adduction of the talus while the lateral flange controls the abduction of the forefoot.

Flattening of the arch occurs in three planes. The frontal plane, the sagittal plane and the transverse plane. The sagittal and frontal planes are controlled with the inverted position of the heel as well as the the use of a medial raise on the medial side of the device which corresponds to the arch and extends to the first metatarsal neck. The third plane, which is the transverse plane, is controlled with the use of a lateral flange which extends to the neck of the fifth metatarsal. This provides complete stabilization in the transverse plane, something which has not been controlled with standard orthotic devices. The transverse plane is extremely important to control in the prevention of bunion deformities. The lateral flange extends up along the side of the foot as does the medial flange. The present invention thus deals with the position of the calcaneus, and its off set insert within the cup, as well as the lateral flange extending to the fifth metatarsal neck.

PRIOR ART

The closest prior art is illustrated by U.S. Pat. Nos. 4,759,357 (Allart), 4,747,410 (Cohen) and 4,360,027 (Frielander). While some of this art discloses a deep heel seat, there is no indication that such a prior art heel seat was offset to provide an inverted position within the cup itself. In summation, none of the prior art shows the combination of the following features of the present invention:

1. A lateral flange extending through to the fifth metatarsal neck, just proximal to the head.
2. A medial flange extending through the heel cup distally to the proximal aspect of the first metatarsal head.
3. A central cut out area with two legs extending just proximal and plantar to the first and fifth metatarsal heads.
4. A heel cup positioned in an inverted fashion, the axis of the heel cup being off-set.
5. An optional extrinsic posting is available to the offset inverted heelcup.

BRIEF DESCRIPTION OF THE DRAWINGS

In order to more fully understand the invention, reference should be had to the following specification taken in connection with the attached drawings wherein.

DETAILED DESCRIPTION OF THE INVENTION

Figure 1:
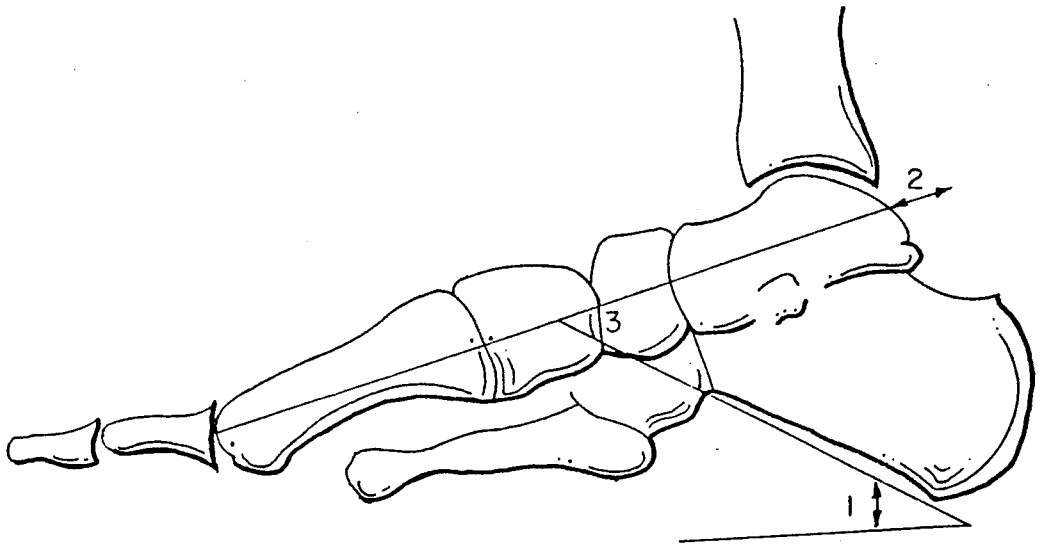
FIG. 1 is a lateral view of the normal right foot.
Figure 2:
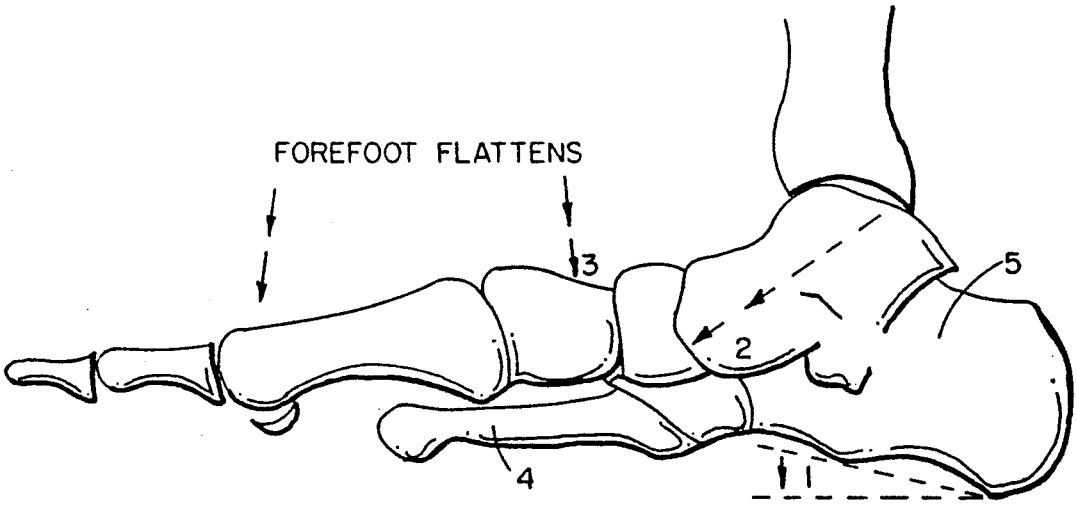
FIG. 2 is a lateral view of the pronating right foot.
Figure 3:
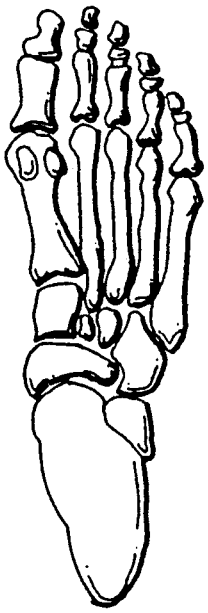
FIG. 3 is a normal right foot top view.
Figure 4:
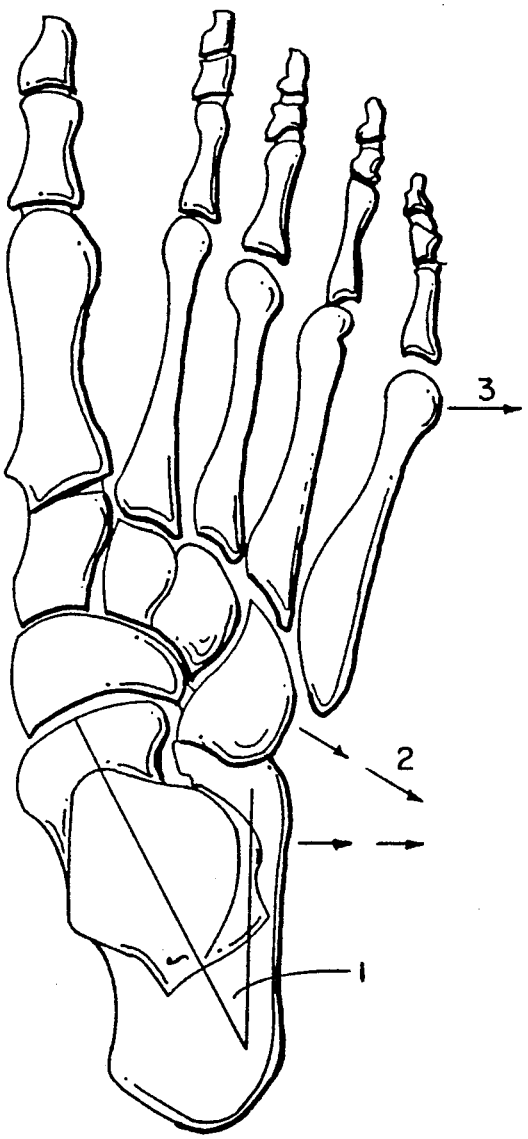
FIG. 4 is a pronating right foot top view (hyperpronated).

Referring now to the drawings, it can be seen that by comparing FIGS. 1 and 2, the hyperpronated foot results in a significant lowering of the normal arch with the attendant medical problems. The hyperpronated foot, as seen by comparing FIGS. 3 and 4, is also spread laterally with the resultant medical problems enumerated above.

Figure 7:
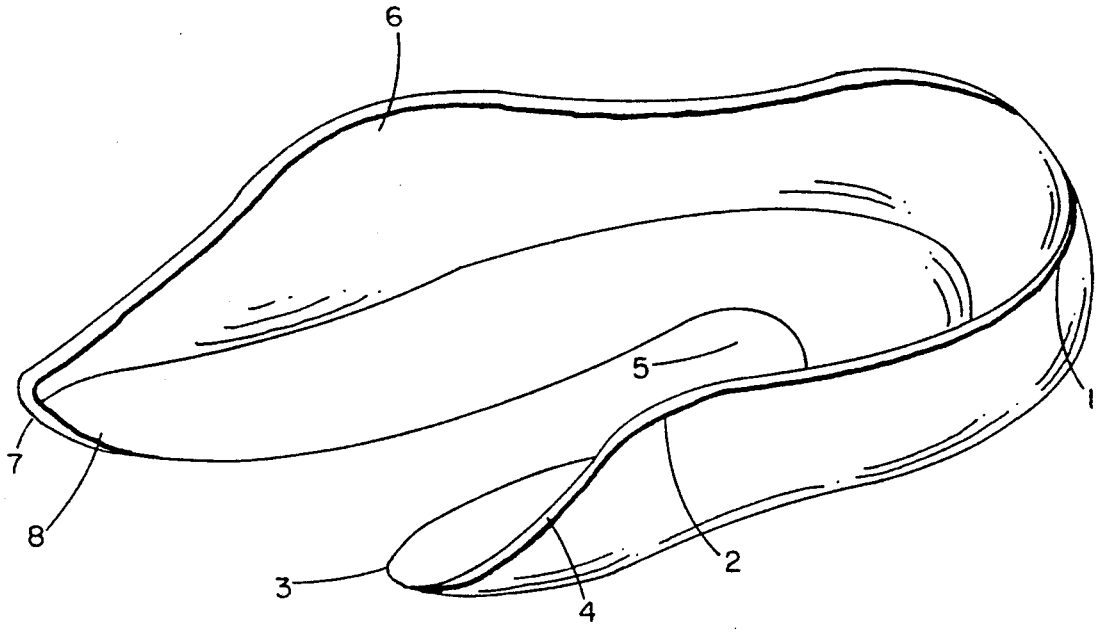
FIG. 7 is a perspective view of a preferred embodiment orthotic device of the present invention.
Figure 17:
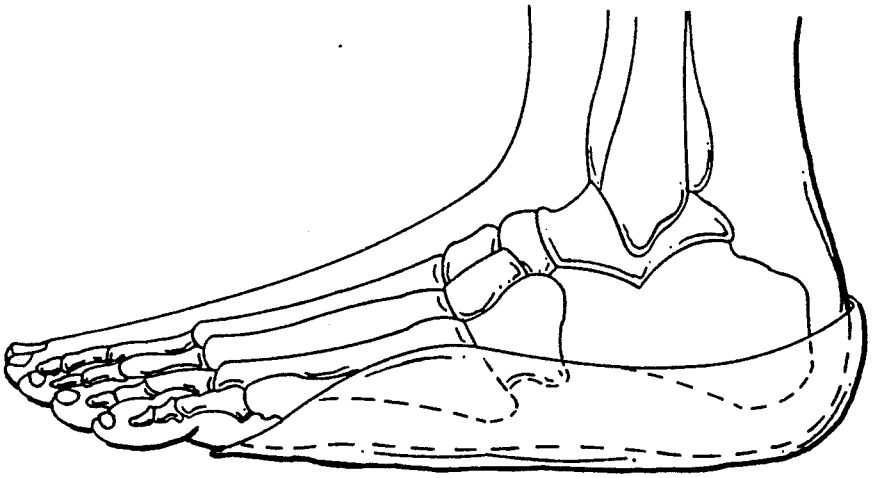
FIG. 17 is a lateral view of left foot with the orthotic device preventing lateral drift.
Figure 8:
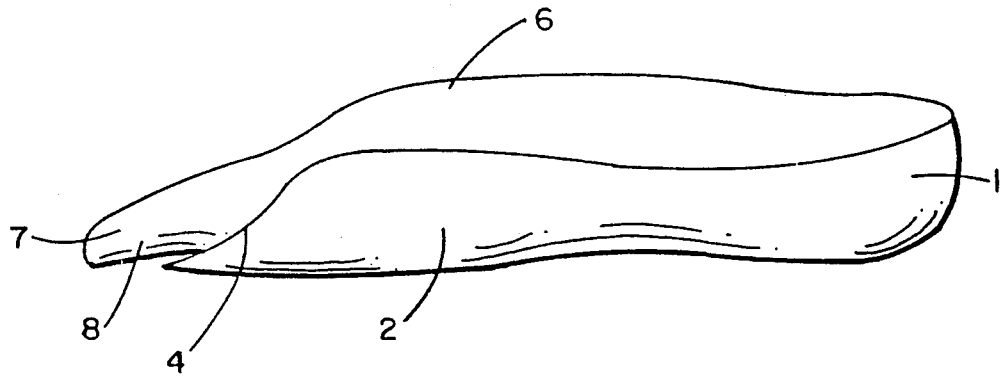
FIG. 8 is the orthotic device lateral view.
Figure 9:
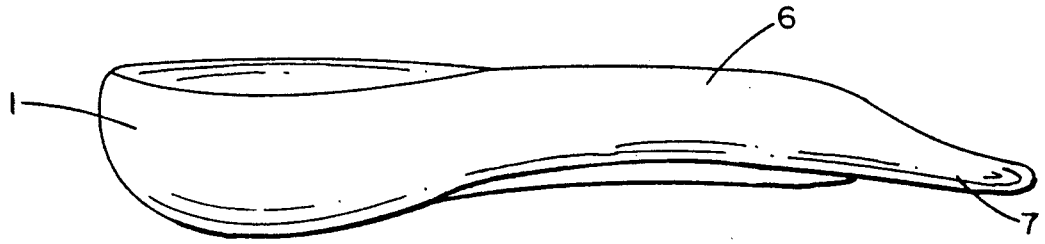
FIG. 9 is the orthotic device medial view.
Figure 10:
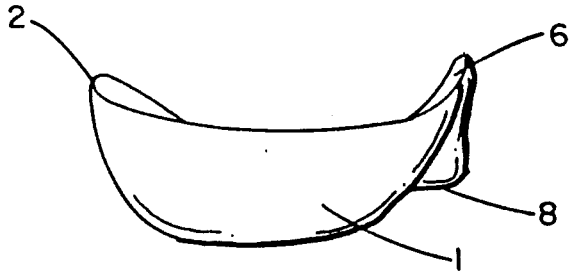
FIG. 10 is the orthotic device rear view.

FIG. 7 is a perspective view of one preferred embodiment of the invention showing a molded structure comprising the deep inverted heel cup (1) with the lateral flange (2). This flange continues distally to just proximal to the fifth metatarsal head. There is a cut out deep heel seat (5) which creates two plantar supports medial and lateral. The high medial flange (6) rests adjacent to the Talo-navicular and cunio-navicular articulation. The distal end of the medial flange (7) ends approximal to the first metatarsal head and the plantar medial flange (8) ends proximal to the sesamoid apparatus.

Figure 5:
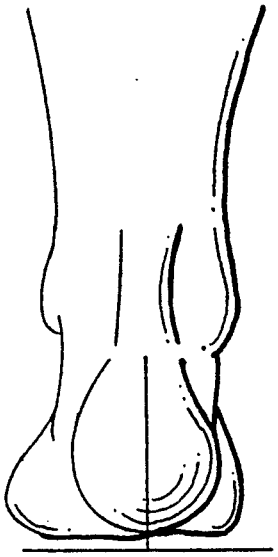
FIG. 5 is a normal right foot rear view.
Figure 6:
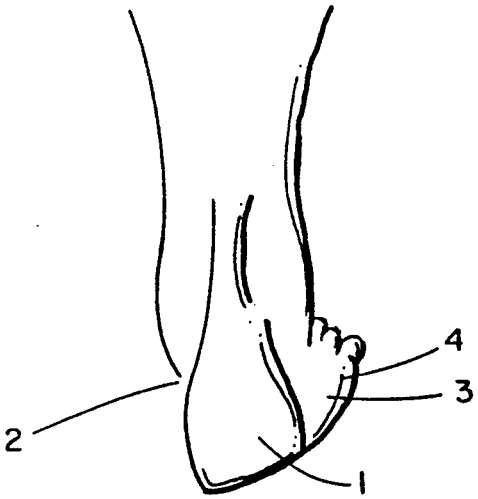
FIG. 6 is a pronating right foot rear view (hyperpronated).
Figure 12:
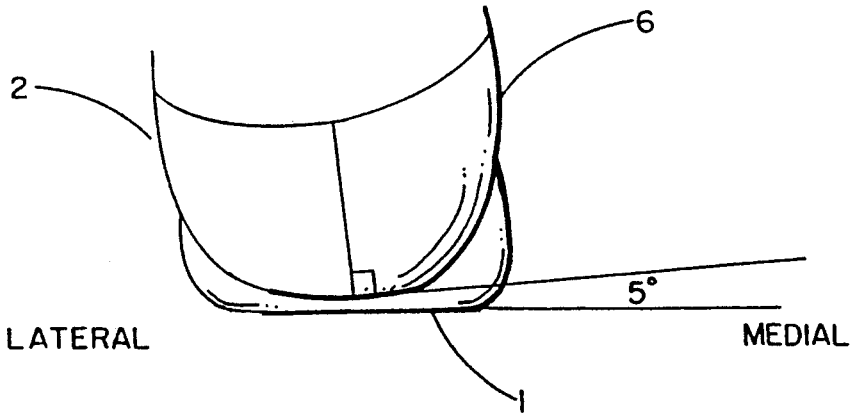
FIG. 12 is an offset 5 degree rearfoot heelcup—rear view.
Figure 13:
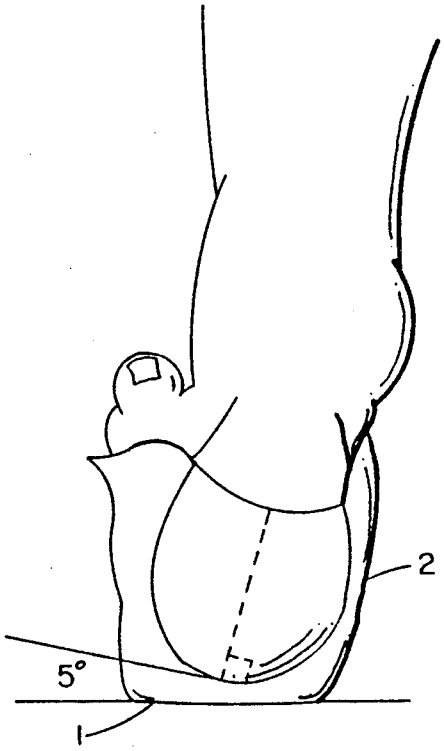
FIG. 13 is a rear view of right foot with inverted heelcup and calcaneus.
Figure 15:
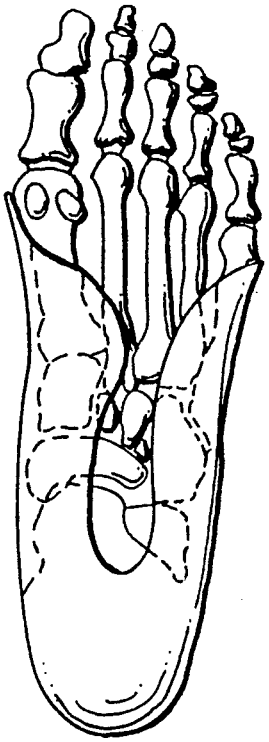
FIG. 15 is a bottom view of foot with stabilizing effect of the orthotic device.
Figure 14:
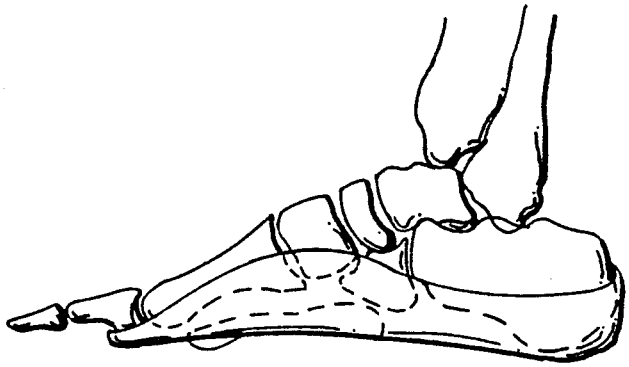
FIG. 14 is a medial view of the orthotic device stabilizing right foot.
Figure 16:
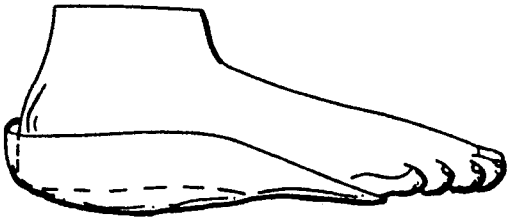
FIG. 16 is a lateral view of the orthotic device stabilizing right foot.
Figure 18:
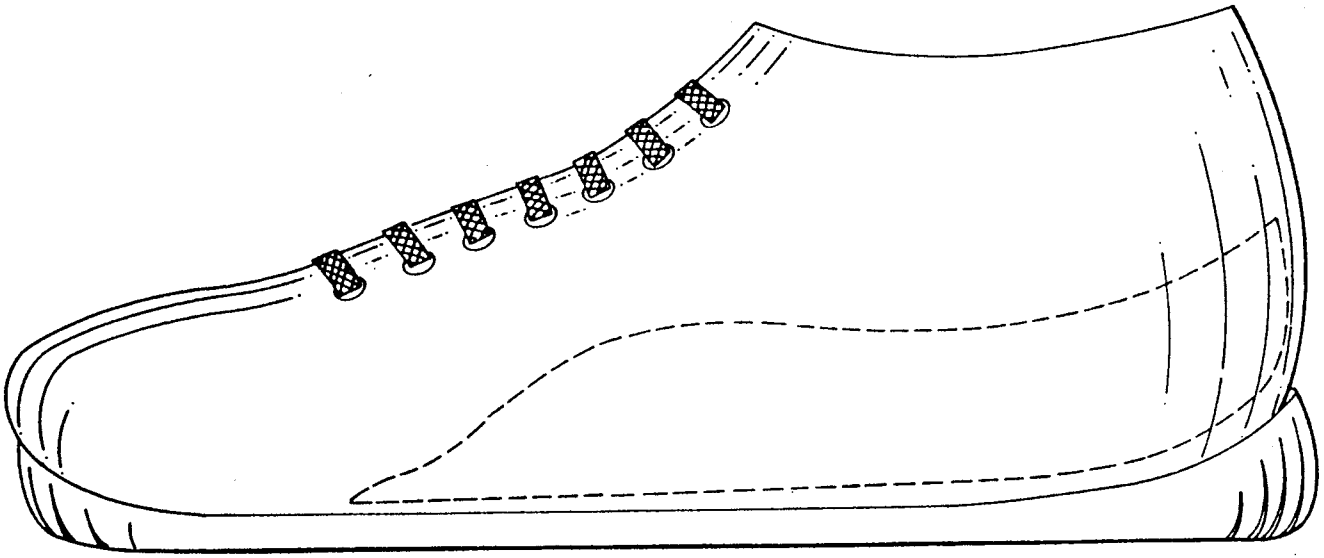
FIG. 18 is a side elevational view in cross section showing the orthotic device positioned in a shoe.

Referring now to FIGS. 5 and 12, normally the vertical axis of the calcaneus is perpendicular to the ground plane. By application of the present invention, as shown in FIG. 12, the axis of the calcaneus is tilted with 5° varus, this tilt preventing displacement between the calcaneus and the overlying talus. When this joint is locked, the arch is maintained and it will generally retain the position shown in FIG. 1; it will not flatten to the position shown in FIG. 2.

Figure 11:
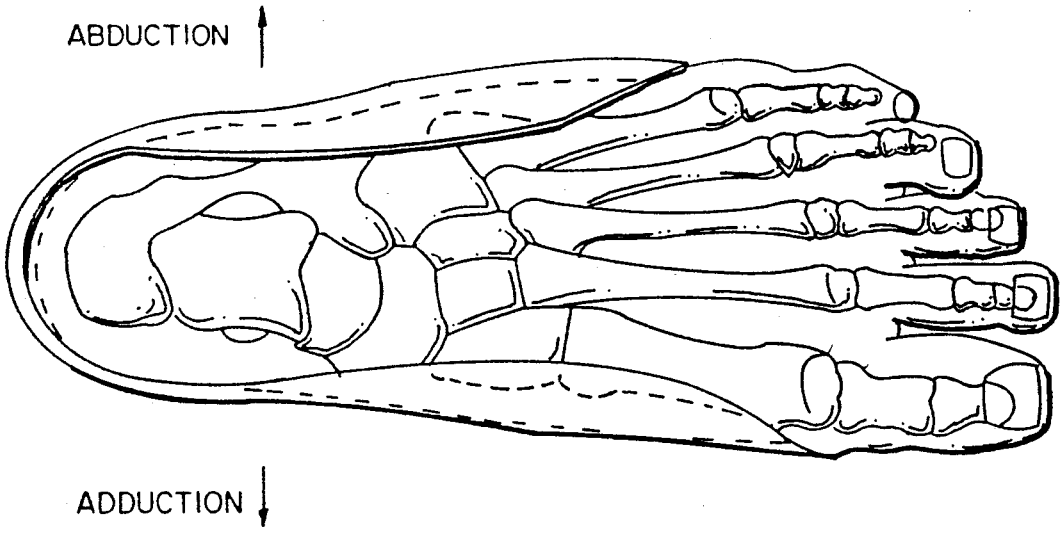
FIG. 11 is a top view of foot with the orthotic device-left foot.

Another important feature of the present invention is illustrated in FIG. 11, which view shows the relationship of the medial and lateral flanges which prevent spreading of the foot as weight moves from the calcaneus to the ends of the metatarsals. This confinement of the first and fifth metatarsal also assists in maintaining the arched structure of the foot, particularly in combination with the high medial flange (6) which bears on the navicular to retain it in the elevated normal position.

A review of the above drawings and the attached specification will indicate the operation of the present invention with respect to a foot which would have a tendency to hyperpronate. When the insert of the present invention is placed in the shoe (or the shoe is built to have the shape of the interior of the insert), the calcaneus is given a 5° inversion. This locks the mid tarsal joint to hold the arch in the normal preferred position. During walking, as weight is transferred to the foot, the remainder of the insert comes into play and the high medial flange applies a stabilizing force to the navicular plantar and to the outer metatarsals to prevent their spreading apart and contributing to the arch weakening. The insert provides stability in the transverse plane and does not stop all motion, but allows normal motion and prevents excessive motion.

This design, with its high medial and lateral flanges extending distally just proximal to the metatarsal phalangeal joints, prevents the lateral, transverse drift of the metatarsals and the midtarsal joint. The stabilizing effect of the inverted off set heel cup, maintaining the subtalar joint in a locked and neutral inverted position, further locks the midtarsal joint preventing lateral drift of the forefoot. An important difference in this product from the ones of the prior art is in the prevention of the lateral drift with the use of the lateral stabilizing flanges and the inverted off set heel cup.

In a preferred embodiment of the invention, an insert of the present invention is formed by molding semi-rigid material to the approximate shape as shown. This semi-rigid molding preferably has a varying rigidity, being more rigid and stiff at the heel cup and having somewhat less stiffness and rigidity towards the forefoot. Such a varying rigidity can be conveniently created by using a compressible heatset foam whose rigidity is a function of the degree of compression during molding and compressing the heel section to a higher degree than the remainder of the molding. A lining for the medial flange which is a slightly more compressible layer may be included or it could be molded (in situ) with a slightly higher compressibility than the remainder of the major portion of the insert.

In calculating the degree of inversion of the calcaneus, this is accomplished by shaping the cup so that the medial leg (6) of the orthotic device rises more steeply from the bottom of the cup (1) then does the lateral leg (2). This tends to shift the point of engagement of the bottom of the calcaneus with respect to the bottom of the cup so that it is in an inverted position of approximately 5° from the normal vertical. This angle may vary somewhat from the preferred 5° but too much of an angle of inversion will cause discomfort and not enough, (one or two degrees), will not accomplish the desired locking of the midtarsal joint. In general, for a healthy foot, where the orthotic device is not being used to correct a flat foot, the angle of inversion can be between about 3° and 5°. However for a medical problem (to be considered when foot casted) where a flat foot is to be corrected, the angle should be somewhat higher (between about 5° to 7°) and the orthotic device should be more rigid to prevent any pronation.

As a result of the in-shoe device being worn by patients of varying ages, control of the foot will be improved significantly and depending upon the degree of deformity which the patient presents will determine what degree of professional care will be necessary. It is recognized that the majority of patients are not treated for their hyperpronation problems but would significantly benefit from early and complete control. Once again recognizing that these problems are missed at the Pediatric level the majority of the population that is treated with in shoe devices and shoe modifications are of the age category that we would consider adults. It is for this reason that these patients would be kept comfortable with the use of a shoe modification which would be built directly into the shoe or available to be placed in the shoe itself. Foot gear in which these modifications would be utilized would be widely diversified and would include running shoes, sneakers and standard foot wear with the exception of very high heel shoes. Flat shoes of any type and heel heights of approximately up to an inch to an inch and a half would be most appropriate as well as the athletic foot wear industry. Recognizing that the majority of the population readily wears athletic shoes either for recreational activities or normal walking, the device would easily and naturally be part of the athletic foot wear. It is essential to be part of the athletic shoe in that most sports place an additional force through the foot exaggerating abnormal or hyperpronation. It is therefore essential to be controlling these patients while wearing this type of foot gear and engage in this type of activity. These types of activities would include but not be limited to tennis, basketball, racketball, aerobics and jogging, etc.

While a preferred embodiment of the invention has been described above, other forms thereof will be apparent to one skilled in the art without departing from the spirit of the invention.

What is claimed is:

1. An orthotic device for preventing hyperpronation of a human foot comprising a deep rigid heel seat to cup the calcaneus, said heel cup being medially offset and laterally tilted by a sufficient amount to maintain the calcaneus in approximately 5 degrees of varus, and high medial and lateral flanges which extend continuously high along the medial and lateral sides of the orthotic substantially to the first and fifth metatarsal necks, respectively, said high medial flange applying a stabilizing force to the navicular plantarly and said medial and lateral flanges serving to prevent lateral transverse drift of the first and fifth metatarsals.

2. A footwear product having as an element thereof an orthotic device as claimed in claim 1.

* * * * *

US005174052C1

(12) EX PARTE REEXAMINATION CERTIFICATE (5462nd)

United States Patent
Schoenhaus et al.

(10) Number: US 5,174,052 C1
(45) Certificate Issued: Aug. 1, 2006

(54) DYNAMIC STABILIZING INNER SOLE SYSTEM

(75) Inventors: Harold D. Schoenhaus, Cherry Hill, NJ (US); Richard M. Jay, Philadelphia, PA (US)

(73) Assignee: Schering-Plough Healthcare Products, Inc., Memphis, TN (US)

Reexamination Request:
No. 90/007,191, Sep. 3, 2004

Reexamination Certificate for:

| | |
|---|---|
| Patent No.: | **5,174,052** |
| Issued: | **Dec. 29, 1992** |
| Appl. No.: | **07/637,308** |
| Filed: | **Jan. 3, 1991** |

(51) Int. Cl.
*A61F 5/14* (2006.01)

(52) U.S. Cl. ..... 36/144; 36/174; 36/176
(58) Field of Classification Search ..... 36/144, 36/28, 43, 44, 71, 25 R, 140, 154, 173, 174, 36/176
See application file for complete search history.

(56) References Cited

U.S. PATENT DOCUMENTS

| | | | |
|---|---|---|---|
| 4,232,457 | A | 11/1980 | Mosher |
| 4,235,028 | A | 11/1980 | Riggs |
| 4,255,877 | A | 3/1981 | Bowerman |
| 4,288,929 | A | 9/1981 | Norton et al. |
| 4,446,633 | A | 5/1984 | Scheinhaus et al. |
| 4,747,410 | A | 5/1988 | Cohen |
| 4,759,357 | A | 7/1988 | Allart et al. |

OTHER PUBLICATIONS

Richard M. Jay; "Orthoses for Cerebral Palsy Patient" Current Podiatric Medicine, Jan. 1989, pp. 26–27.
1984 Mizuno Catalog, p. 24.
1984 Mizuno Catalog, p. 58.
1987 Mizuno Catalog, p. 109.

*Primary Examiner*—M. D. Patterson

(57) ABSTRACT

An orthotic device for preventing hyperpronation of a human foot has a deep heel seat to cup the calcaneous and maintain it in approximately 5 degrees of varus, and high medial and lateral flanges which prevent lateral transverse drift of the first and fifth metatarsals.

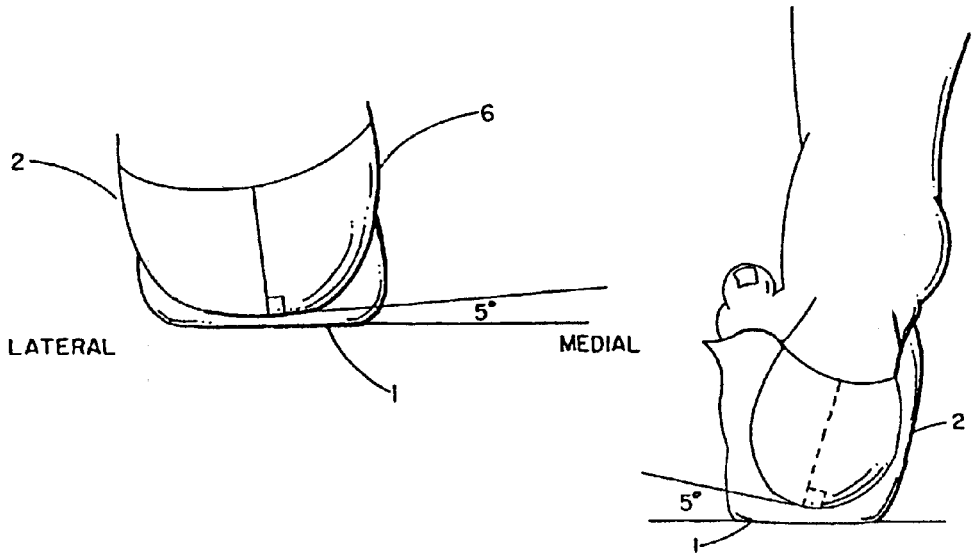

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 2 is confirmed.

New claims 3–8 are added and determined to be patentable.

*3. The orthotic device according to claim 1, wherein the orthotic device is part of the construction of a shoe and is not removable therefrom.*

*4. The orthotic device according to claim 1, wherein the orthotic device is adapted to be placed within a shoe and is removable therefrom.*

*5. The orthotic device according to claim 1, wherein the orthotic device is an insert.*

*6. The footwear product according to claim 2, wherein said orthotic device is part of the construction of the footwear product itself and is not removable therefrom.*

*7. The footwear product according to claim 2, wherein said orthotic device is adapted to be placed within the footwear product and is also adapted to be removable therefrom.*

*8. The footwear product according to claim 2, wherein said orthotic device forms an insert.*

* * * * *